US008123254B2

(12) United States Patent
Conrad et al.

(10) Patent No.: US 8,123,254 B2
(45) Date of Patent: Feb. 28, 2012

(54) METHOD FOR MOUNTING ARTWORK REPRODUCTIONS PRINTED ON A DEFORMABLE SUBSTRATE AND FOR INCORPORATING A PRINTED DEFORMABLE SUBSTRATE IN A PUBLICATION

(75) Inventors: Helmut Horst Gerhard Conrad, Hampton (CA); Ron Hills, Hampton (CA); Wayne Ernest Conrad, Hampton (CA); Nina Kanevsky Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 947 days.

(21) Appl. No.: 11/571,317

(22) PCT Filed: Sep. 16, 2005

(86) PCT No.: PCT/CA2005/001415

§ 371 (c)(1), (2), (4) Date: Apr. 22, 2008

(87) PCT Pub. No.: WO2006/029531

PCT Pub. Date: Mar. 23, 2006

(65) Prior Publication Data

US 2008/0265559 A1 Oct. 30, 2008

Related U.S. Application Data

(60) Provisional application No. 60/610,170, filed on Sep. 16, 2004.

(51) Int. Cl.
*B42D 1/00* (2006.01)
*B42D 5/00* (2006.01)
*B42D 15/00* (2006.01)

(52) U.S. Cl. ..... 281/15.1; 281/21.1; 281/28; 281/38; 283/56; 283/63.1; 283/107; 283/109

(58) Field of Classification Search ..... 281/15.1, 281/21.1, 28, 29, 31, 38, 51; 283/56, 63.1, 283/94, 107, 109; 402/79; 412/6
See application file for complete search history.

(56) References Cited

U.S. PATENT DOCUMENTS 2,180,551 A 11/1939 Sawdon et al.

(Continued)

FOREIGN PATENT DOCUMENTS

CA 2134170 A 4/1996

(Continued)

OTHER PUBLICATIONS

International Search Report received on the corresponding International Application No. PCT/CA05/001415, dated Jan. 30, 2006.

(Continued)

*Primary Examiner* — Dana Ross
*Assistant Examiner* — Justin Lewis
(74) *Attorney, Agent, or Firm* — Philip C. Mendes da Costa; Bereskin & Parr LLP S.E.N.C.R.L., s.r.l.

(57) ABSTRACT

A non-cellulose based deformable substrate having at least one fold line is configured to be able to be directly mounted on a frame or included in a publication. The substrate is configured to reduce the propagation of stress along the at least one fold line.

25 Claims, 14 Drawing Sheets

U.S. PATENT DOCUMENTS

| | | | | |
|---|---|---|---|---|
| 2,314,087 | A | | 3/1943 | Heller |
| 2,977,639 | A | | 4/1961 | Barkhuff et al. |
| 3,734,544 | A | * | 5/1973 | Fishkin et al. ..... 283/56 |
| 3,950,869 | A | * | 4/1976 | Samarin ..... 38/102.91 |
| 4,001,062 | A | | 1/1977 | Iisaka et al. |
| 4,115,939 | A | | 9/1978 | Marks |
| 4,187,572 | A | * | 2/1980 | Savich ..... 281/28 |
| 4,385,360 | A | | 5/1983 | Yamada et al. |
| 4,492,306 | A | * | 1/1985 | Cooper et al. ..... 281/15.1 |
| 4,819,963 | A | | 4/1989 | Wolski |
| 4,971,743 | A | | 11/1990 | Lang |
| 5,098,127 | A | | 3/1992 | Williamson et al. |
| 5,181,745 | A | * | 1/1993 | Jacobsen et al. ..... 283/94 |
| 5,182,063 | A | | 1/1993 | Lang et al. |
| 5,259,496 | A | | 11/1993 | Common |
| 5,261,701 | A | * | 11/1993 | Walters ..... 281/29 |
| 5,473,159 | A | | 12/1995 | Krieger |
| 5,557,904 | A | | 9/1996 | Dahowski |
| 5,590,912 | A | | 1/1997 | Stevens |
| 5,667,747 | A | | 9/1997 | Harding et al. |
| 5,904,962 | A | | 5/1999 | Harding et al. |
| 5,958,470 | A | | 9/1999 | Harding et al. |
| 6,060,171 | A | | 5/2000 | Greenblat et al. |
| 6,105,762 | A | | 8/2000 | Pettey |
| 6,224,106 | B1 | | 5/2001 | Murphy |
| 6,248,441 | B1 | | 6/2001 | Anderson et al. |
| 6,360,887 | B1 | | 3/2002 | Pettey |
| 6,409,447 | B2 | | 6/2002 | Malmros |
| 6,444,148 | B2 | | 9/2002 | Harding |
| 2002/0141849 | A1 | | 10/2002 | Trovinger et al. |
| 2003/0160443 | A1 | * | 8/2003 | Ramella et al. ..... 283/63.1 |

FOREIGN PATENT DOCUMENTS

| | | | |
|---|---|---|---|
| CA | 2411367 | A | 5/2003 |
| JP | 55142609 | A | 4/1979 |
| JP | 07047597 | A | 7/1994 |
| JP | 2000335683 | A | 5/1999 |

OTHER PUBLICATIONS

International Search Report received on the related International Application No. PCT/CA05/01578, dated Jul. 11, 2006.

International Search Report received on the related International Application No. PCT/CA05/001579, dated Feb. 27, 2006.

International Search Report, received on the related International Application No. PCT/CA05/001577, dated Feb. 28, 2006.

* cited by examiner

METHOD FOR MOUNTING ARTWORK REPRODUCTIONS PRINTED ON A DEFORMABLE SUBSTRATE AND FOR INCORPORATING A PRINTED DEFORMABLE SUBSTRATE IN A PUBLICATION

FIELD OF THE INVENTION

This invention relates to methods for using a deformable substrate such as polystyrene or poly vinyl chloride (PVC). In one aspect, this invention relates to a mounting system for artistic works, and in particular art reproductions, which are made on a deformable substrate, so as to enable the artistic work to be displayed on a wall. In other embodiment, this invention relates to a method to incorporate a printed deformable substrate into a publication, such as a magazine or journal, and to a publication made by the method.

BACKGROUND OF THE INVENTION

Over the past 20 years, considerable efforts have been made to create inexpensive reproductions of original artwork. See for example U.S. Pat. Nos. 5,958,470 and 5,904,962.

Such reproductions are often created on PVC substrates which resist tearing, but were harmful to the environment if the reproductions were discarded to landfill either due to flaws created during the manufacturing process or due to the reproduction being disposed of by a consumer. The use of polystyrene or other environmentally friendly materials is complicated by the fact that polystyrene is relatively fragile and is subject to fracturing and tearing. Accordingly, while polystyrene is more environmentally friendly, it poses additional problems during the manufacturing process.

SUMMARY OF THE INVENTION

In accordance with the instant invention, improved methods and configurations are provided for utilizing deformable substrates.

In accordance with one aspect of this invention, a reproduction of an original work of art is prepared on a substrate, which is preferably a thermoformable plastic. The corners or other sections of the reproduction that are cut out or notched to facilitate mounting of the artwork are configured to reduce the propagation of stress. Such stress may result in the creation or propagation of rips, tears or cracks in the thermoformable substrate. Preferably, a small round or oval hole may be provided if there is an angle over 5° formed when a substrate is notched or has a corner or other piece cut out therefrom to permit the substrate to be attached to a frame or otherwise mounted thereby preventing or reducing the likelihood of tears or fractures occurring in the substrate.

The reproduction may be two-dimensional. For example, an image may be provided on the front or image bearing face of the substrate, such as by being printed thereon. Alternately, or in addition, the substrate is treated, such as by being subjected to pressure and/or vacuum forming, to create a three-dimensional representation or topography corresponding to, e.g., an original piece of art. This reproduction may optionally be adhered to a canvas substrate to further reproduce the appeal of the original art piece.

For example, an art reproduction may be printed on a single sheet of polystyrene. The polystyrene may have the corners cut out so as to provide four flanges, which are subsequently bent around a frame assembly so as to thereby permit the art reproduction to be secured to a frame. In such a case, the corner formed between two adjacent flanges is preferably configured as set out herein. Accordingly, when the flanges are bent to fit over the frame, the stress from the deformation of the plastic will not propagate past the corner and, in particular, will not propagate into the image-bearing portion of the substrate. It will be appreciated that when a thermoformable substrate is bent at room temperature, or in some cases at an elevated temperature, that the substrate may tend to crack by the stress imposed when the substrate is deformed. This crack will tend to propagate along the line of stress (i.e. the axis along which the substrate is bent). By rounding such a corner, the propagation of the crack is blunted and prevents the crack from propagating along additional portions of the substrate. Also, in some cases, the rounding of corners may also result in the substrate not cracking when it is bent so as to be attached to a frame.

In accordance with another embodiment of the instant invention, a substrate may be included as a page in a publication. For example, a thermoformable plastic sheet may be printed and incorporated in a publication, such as a book or magazine. The publication may be bound by spot gluing, heat staking, stapling, sewing or otherwise mechanically affixing the pages together. If a staple or other mechanical member such as a post or ring is inserted through the substrate, then the passage of the staple through the substrate will provide a point of stress, which may result in a crack being formed that extends through the image-bearing portion of the substrate. Accordingly, if a substrate is to be incorporated as a page in a publication by being bound as a page in the publication, then the substrate is configured to receive the staple or other member that may pierce the substrate without the substrate being deformed of pierced. Preferably, holes are provided at a location where the staple or other binding will pass through the substrate. Preferably, the substrate is also thickened at the portion where the hole is provided.

According to one aspect of the invention, there is provided a member comprising:

(a) a deformable self-supporting substrate having an image reproduced on a face thereof, (b) the substrate having first and second portions, the two portions meeting at a first fold line, the first fold line having first and second opposed ends; and, (c) at least one of the ends is configured to reduce propagation of stress along the first fold line.

In one embodiment each of the portions has an edge, the edges meet at one of the opposed ends, when the portions are folded along the first fold line a section of each edge adjacent the first fold line defines a point and the sections of each edge adjacent the first fold line are rounded in planes defined by the portions of the substrate.

In another embodiment the sections are radiused in the planes defined by the portions of the substrate.

In another embodiment the sections create a generally concave indent when viewed from the edges.

In another embodiment, when the portions are folded along the first fold line a section of each edge adjacent the first fold line defines a point, the substrate has a thickness, and the thickness is increased adjacent the point.

In another embodiment each of the portions has an edge and generally extends in a plane, the edges meet at a point at one of the opposed ends, and the substrate is configured to extend out of the planes adjacent the point. Preferably, a section of the substrate adjacent the point is curved out of the planes.

In another embodiment the first portion has an image provided thereon and the member is incorporated into a bound publication.

In another embodiment the image comprises an advertisement.

In another embodiment the bound publication has a plurality of pages and a spine, and the first fold line is positioned adjacent the spine. At least some of the pages may be secured together by an elongate member. Preferably, the elongate member passes through the substrate adjacent the first fold line. More preferably, the substrate is provided with an opening that the elongate member passes through. Preferably, the opening has a round perimeter. Alternately or in addition, the opening has a perimeter, the substrate has a thickness and the thickness of the substrate is increased adjacent the perimeter of the opening. Alternately or in addition, the opening has a perimeter, each of the portions generally extends in a plane, and the substrate is configured to extend out of the planes adjacent the perimeter of the opening. In another embodiment, a section of the substrate adjacent the perimeter of the opening is curved out of the planes.

In another embodiment the substrate is deformed by heat and/or pressure.

In another embodiment the substrate is a thermoformable plastic.

In another embodiment the substrate is plastic or metal. Preferably, the plastic is polystyrene.

In another embodiment the first portion of the substrate has an image provided thereon and the second portion of the substrate defines a first flange and the flange is secured to a frame.

In another embodiment the member comprises artwork.

In another embodiment the substrate further comprises a third portion, the first and third portions meeting at a second fold line, the second fold line having first and second opposed ends, the one of the ends of the first fold line is positioned adjacent one of the ends of the second fold line to define a corner and the corner is configured to reduce propagation of stress along the fold line.

In another embodiment the substrate has a plurality of flanges for mounting the substrate to the frame and corners positioned between the flanges and at least some of the corners having a portion that is rounded.

In another embodiment all of the corners are rounded.

In accordance with another embodiment of the present invention, there is provided a publication comprising:

(a) a plurality of pages and a spine;
(b) a substrate comprised of metal and/or plastic;
(c) the substrate having first and second portions, the two portions meeting at a first fold line, the first fold line positioned adjacent the spine and having first and second opposed ends; and,
(d) at least one of the ends is configured to reduce propagation of stress along the first fold line.

In one embodiment at least some of the pages are secured together by an elongate member.

In another embodiment the elongate member passes through the substrate adjacent the first fold line.

In another embodiment the substrate is provided with an opening that the elongate member passes through.

In another embodiment the opening has a round perimeter.

In another embodiment the opening has a perimeter, the substrate has a thickness and the thickness of the substrate is increased adjacent the perimeter of the opening.

In another embodiment the substrate is comprised of plastic.

In another embodiment the substrate is provided with an image and the image comprises an advertisement.

In accordance with another aspect of the present invention, there is provided a publication comprising:

(a) a plurality of pages and a spine;
(b) a substrate comprised of metal and/or plastic;
(c) the substrate having first and second portions, the two portions meeting at a first fold line, the first fold line is positioned adjacent the spine; and,
(d) an elongate member extending through at least some of the pages and at least one opening in the substrate, the opening is configured to reduce the propagation of stress along the first fold line.

In one embodiment the elongate member comprises a staple.

In another embodiment the elongate member passes through the substrate adjacent the first fold line.

In another embodiment the opening has a round perimeter.

In another embodiment the opening has a perimeter, the substrate has a thickness and the thickness of the substrate is increased adjacent the perimeter of the opening.

In another embodiment the substrate is provided with an image and the image comprises an advertisement.

In another embodiment the substrate is comprised of plastic.

In accordance with another aspect of the present invention, there is provided an art reproduction comprising:

(a) a sheet of deformable self-supporting substrate having an image reproduced on at least a front face of a first portion thereof,
(b) the substrate having flanges for mounting to a frame and corners positioned between the flanges, the flanges and the first portion abutting at fold lines; and,
(c) a first corner is configured to reduce propagation of stress along a fold line adjacent the first corner.

In one embodiment all of the corners are configured to reduce propagation of stress along a fold lines adjacent the corners.

In another embodiment the corner has a portion that is rounded.

In another embodiment the substrate has a thickness and the thickness is increased adjacent the first corner.

In another embodiment each of the flanges adjacent the first corner and the first portion generally define a plane and, adjacent the first corner, the substrate is configured to extend in a direction outwardly from each of the planes.

In another embodiment a section of the substrate adjacent the first corner is curved outwardly from the planes.

In another embodiment the substrate is comprised of plastic.

In another embodiment the image comprises an advertisement.

In another embodiment, the art reproduction further comprises at least one mount configured to receive a light emitting member, wherein a plurality of light emitting members having different lighting properties are interchangeably receivable in the mount In another embodiment, the mount is moveably mounted to the frame between an in use position spaced from the art reproduction and the frame and a shipping position wherein the mount is positioned adjacent the art reproduction and the frame.

In another embodiment, the art reproduction further comprises at least one light emitting member, a member to monitor the time and a controller to adjust the intensity of the light emitting member, color of the light emitting member and/or to actuate the light emitting member based on time of day.

In another embodiment, the controller is programmable by a user whereby the user can adjust the time of day when the controller adjusts the light-emitting member or actuates the light-emitting member.

In another embodiment, the art reproduction further comprises at least one light-emitting member, a member to monitor the intensity of the light in a room where the art reproduction is positioned and a controller to adjust the intensity and/or color of the light-emitting member based on intensity of the light in the room.

In accordance with another aspect of the present invention, there is provided a method of binding a publication having a spine comprising:

(a) providing a plurality of pages;

(b) providing a substrate comprised of metal and/or plastic, the substrate having first and second portions, the two portions meeting at a first fold line, the first fold line positioned adjacent the spine and having first and second opposed ends;

(c) configuring at least one of the ends to reduce propagation of stress along the first fold line; and, (d) securing the plurality of pages and the substrate together.

In one embodiment, step (c) comprises rounding the at least one of the ends.

In another embodiment, step (c) comprises providing a thicker substrate adjacent the end.

In another embodiment, step (c) wherein the first and second portions each generally define a plane and the method further comprises configuring the substrate to extend in a direction outwardly from each of the planes.

In another embodiment, the method further comprises treating the substrate to form a 3-D image therein.

In another embodiment, the publication comprises a magazine and the method further comprises treating the substrate to form a 3-D advertisement therein.

In another embodiment, step (d) comprises passing and elongate member through the plurality of pages and the substrate.

In another embodiment, the elongate member passes through the substrate adjacent the first fold line and the method further comprises providing the substrate with a preformed opening that the elongate member passes through.

In another embodiment, the method further comprises configuring the opening to reduce propagation of stress along the first fold line.

In another embodiment, the elongate member passes through the substrate adjacent the first fold line and the method further comprises providing the substrate with an opening that is configured to reduce propagation of stress along the first fold line.

In accordance with another aspect of the present invention, there is provided a method of binding a publication having a spine comprising:

(a) providing a plurality of pages;

(b) providing a substrate comprised of metal and/or plastic;

(c) providing the substrate with an opening for passage therethrough of an elongate member; and, (d) securing the plurality of pages and the substrate together by passing the elongate member through the opening.

In one embodiment, the opening has a perimeter the method further comprises configuring the opening to reduce propagation of stress through the substrate adjacent the perimeter.

In another embodiment, the opening has a perimeter and the method further comprises rounding the perimeter.

In another embodiment, the opening has a perimeter and the method further comprises providing a thicker substrate adjacent the perimeter.

In another embodiment, the substrate defines at least one plane and the method further comprises configuring the substrate to extend in a direction outwardly from at least one of the planes.

In another embodiment, the method further comprises treating the substrate to form a 3-D image therein.

In another embodiment, the publication comprises a magazine and the method further comprises treating the substrate to form a 3-D advertisement therein.

In another embodiment, the method further comprises forming the opening prior to passing the elongate member through the substrate.

In another embodiment, the method further comprises forming the opening as the elongate member is passed through the substrate.

In accordance with another aspect of the present invention, there is provided a method of framing art comprising:

(a) providing a sheet of deformable self-supporting substrate having an image reproduced on at least a front face of a first portion thereof, (b) providing flanges for mounting the sheet to a frame, the flanges and the first portion abutting at fold lines; and, (c) providing corners positioned between the flanges and configuring at least a first corner to reduce propagation of stress along a fold line adjacent the first corner.

In one embodiment, the method further comprises configuring all of the corners to reduce propagation of stress along a fold lines adjacent the corners.

In another embodiment, wherein step (c) comprises rounding the first corner.

In another embodiment, the substrate has a thickness and the method further comprises providing an increased adjacent the first corner.

In another embodiment, each of the flanges adjacent the first corner and the first portion generally define a plane and the method further comprises configuring the substrate adjacent the first corner to extend in a direction outwardly from each of the planes.

In another embodiment, a section of the substrate adjacent the first corner is curved outwardly from the planes.

In another embodiment, the method further comprises selecting a plastic as the substrate.

In another embodiment, the image is 3-D and the method further comprises forming a 3-D image in the substrate.

In another embodiment, the method further comprises providing at least one mount that is configured to receive a light emitting member, wherein a plurality of light emitting members having different lighting properties are interchangeably receivable in the mount and selecting a light emitting member to enhance illumination of the image.

In another embodiment, the mount is moveably mounted to the frame between an in use position spaced from the substrate and the frame and a shipping position wherein the mount is positioned adjacent the substrate and the frame and the method further comprises position the mount in the shipping position and packaging the art for shipment.

In another embodiment, the method further comprises providing at least one light emitting member, monitoring the time and adjusting the intensity of the light emitting member, color of the light emitting member and/or actuating the light emitting member based on time of day In another embodiment, the method further comprises setting a program is to adjust the time of day when the light-emitting member is adjusted or actuated.

In another embodiment, the method further comprises monitoring the intensity of light in a room where the art is positioned and adjusting the intensity and/or color of the light-emitting member based on the intensity of the light in the room.

One advantage of this invention is that printed thermoplastic substrates maybe incorporated into publications with less concern of the substrate being damaged during the binding process or when the publication is read.

Another advantage of this invention is that thermoformable substrates and, in particular, polystyrene substrates, may be affixed directly to a frame with less likelihood of the substrate being damaged during the framing process.

BRIEF DESCRIPTION OF THE DRAWINGS

These and other advantages of the instant invention will be more fully and completely understood in association with the following description of the preferred embodiments of the invention in which.

DETAILED DESCRIPTION OF THE INVENTION

In accordance with one aspect of this invention, a substrate is configured for mounting to a frame and, preferably a stretcher frame. In accordance with this aspect of the invention, the frame may be any frame known in the framing or advertising arts wherein the substrate that bears an image is bent, folded, deformed and/or pierced so as to secure the substrate to the frame.

As exemplified in FIGS. 1-19, the frame is a stretcher frame that is rectangular. Accordingly, the corners of the substrate are cut out or otherwise notched to define four flanges, one for each side of the frame. The flanges are then secured to the sidewalls of the stretcher frame. It will be appreciated that if the stretcher frame is oval, circular or of some other shape, that the substrate may be similarly treated to prevent, or reduce the likelihood of, cracks, tears, rips or the like propagating across the printed surface of the substrate.

It will be appreciated that a variety of styles for framing or presenting art reproductions may be utilized. Usually the art reproductions are framed in some manner to enhance the character of the reproduction. In FIGS. 1-9 and 10-19, two alternate methods for mounting an art reproduction to a stretcher frame are provided, although other combinations are possible employing the technique of the instant invention.

Figure 1:
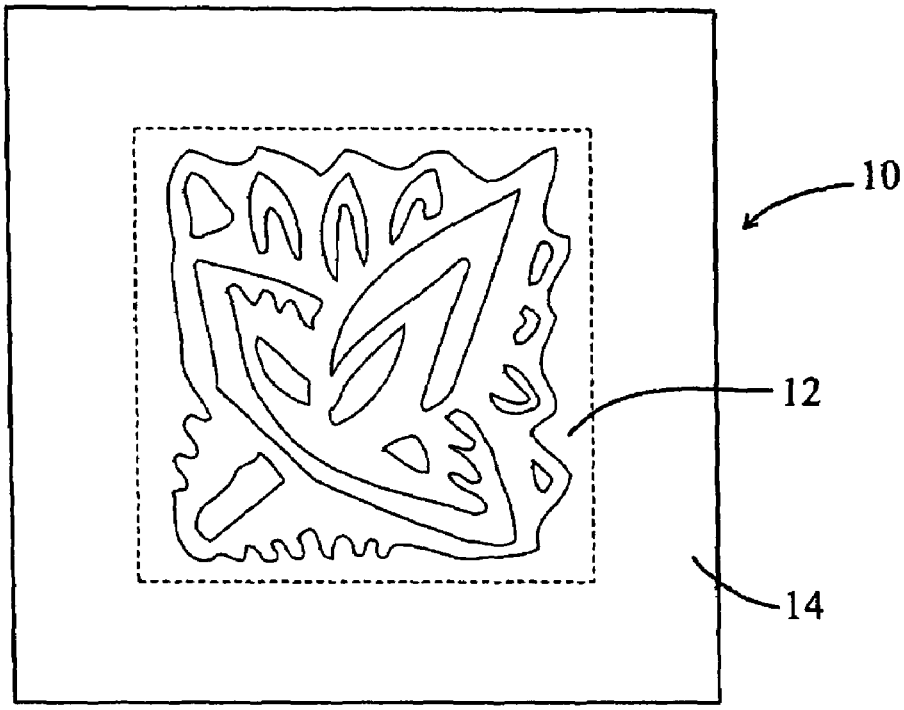
FIG. 1 is a top plan view of an art reproduction without corners notched.

As shown in FIG. 1, art reproduction 10 has an image bearing portion 12 and a perimeter 14. Preferably, no image or topography is formed in perimeter 14.

Figure 2:
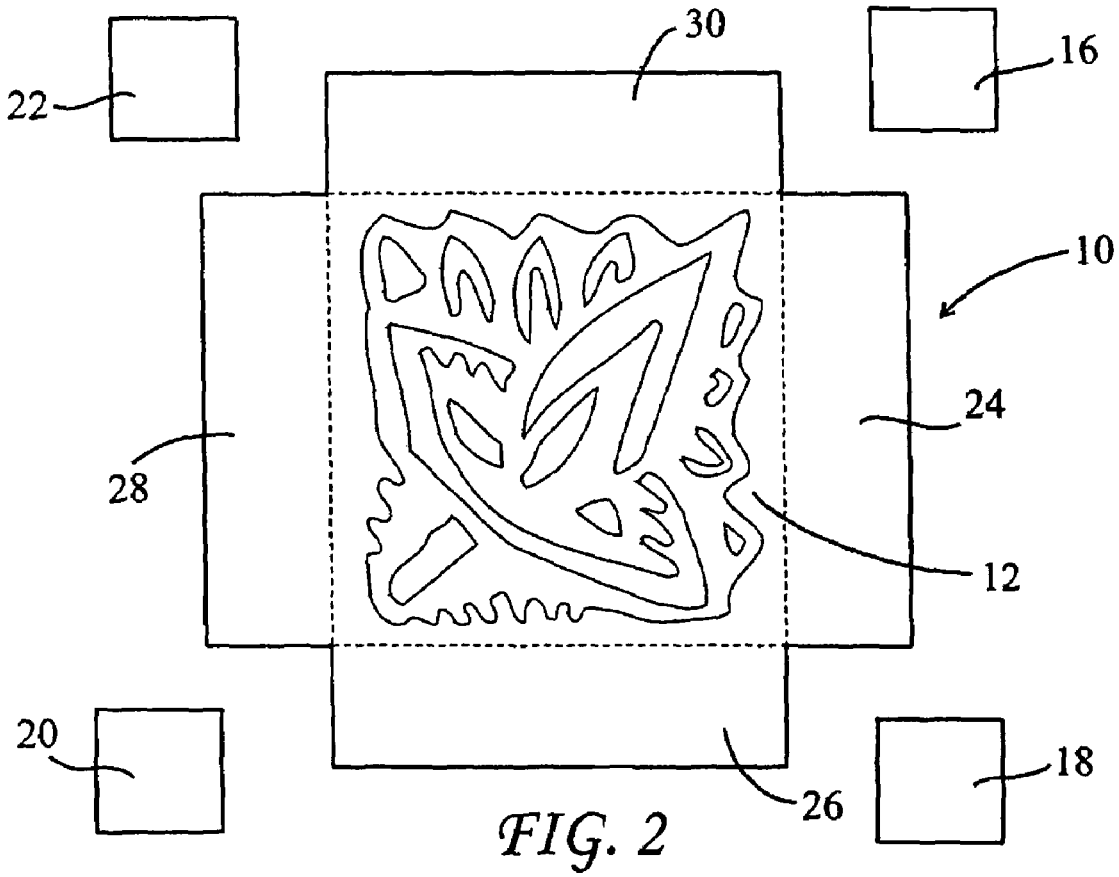
FIG. 2 is a top plan view of the art reproduction of FIG. 1 wherein the corners are notched.

As shown in FIG. 2, corners 16, 18, 20 and 22 are removed from perimeter 14 leaving flanges 24, 26, 28 and 30. Flanges 24, 26, 28 and 30 may be of any particular size that are suitable for securing art reproduction 10 to a frame. Flanges 24, 26, 28 and 30 may be folded along fold line 32, which defines the interface of image bearing portion 12 and the flanges. In order to assist flanges 24, 26, 28 and 30 to be folded, fold line 32 may be perforated or otherwise scored or configured to facilitate the flanges being bent so as to be secured to a frame. It will also be appreciated that the flanges may be bent while the rigidity of the plastic has been temporarily weakened, such as by heating the plastic and/or by applying a solvent, such as methyl ethyl ketone to the flanges.

In accordance with this aspect of the instant invention, at least one, and preferably at least a plurality of and, most preferably, each corner is provided with a corner notch detail 34 which is configured to reduce propagation of stress along fold line 32. For example, each corner may be radiused or have a hole provided therein. Preferably, the hole is circular or oval. The substrate is preferably so configured when be provided if there is an angle over 5° between adjacent sides of the substrate.

Figures 3, 3A:
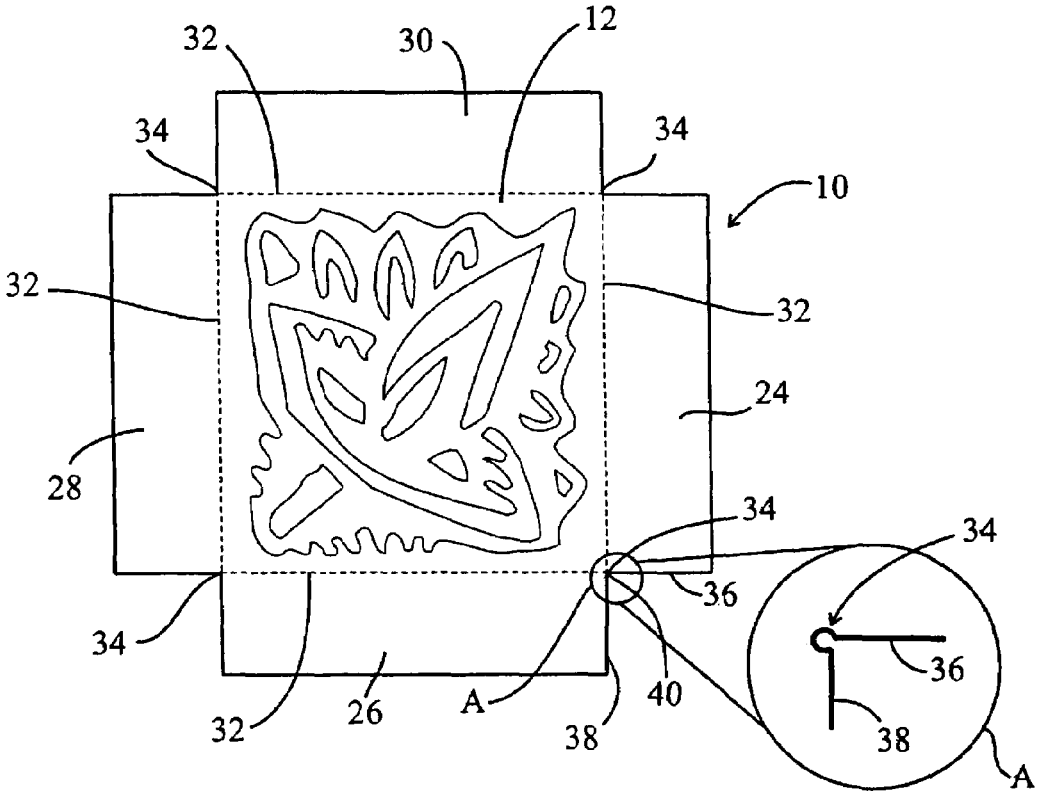
FIG. 3 is a top plan view of the art reproduction of FIG. 2, wherein the corners are notched and wherein the corners are radiused according to a first embodiment of one aspect of the instant invention.
FIG. 3*a* is an enlargement of area A of FIG. 3.

FIG. 3*a* shows an enlargement of corner detail A of FIG. 3. Flange 24 has a side 36 and flange 26 has a side 38. Sides 36 and 38 meet at point 40. If corner 18 is removed as shown in FIG. 2, then corner 40 defined by adjacent sides 36 and 38 will comprise essentially a right angle. As shown in FIG. 3, in accordance with one embodiment of this instant invention, point 40 is configured to reduce the propagation of stress along fold line 32. Accordingly, for example, as shown in FIG. 3*a*, a small round hole or oval is provided at point 40. This is a stress relief cut which serves to prevent or reduce the likelihood of tearing or fracturing of the substrate by distributing the load imposed by the subsequent folding and bending of flanges 24 and 26 during the mounting process. While not shown in FIG. 3*a*, preferably each corner is so treated. It will be appreciated that instead of providing a small hole at point 40, that point 40 may merely be radiused or curved.

Figure 4:
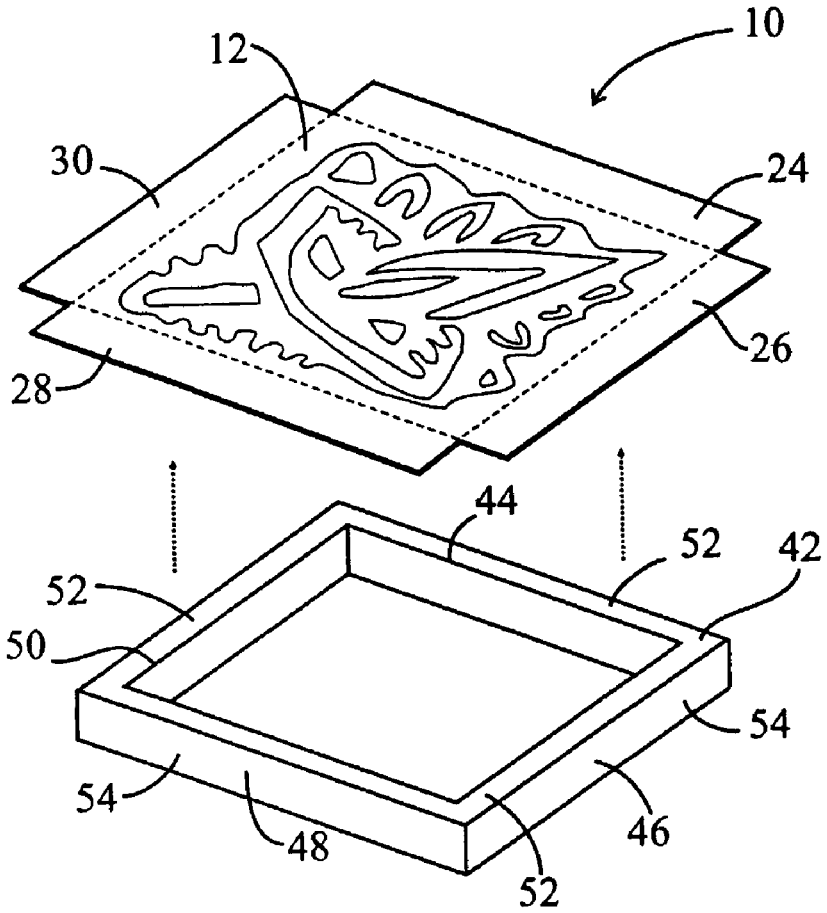
FIG. 4 is a perspective view of the artwork reproduction of FIG. 3 being mounted to a stretcher frame.

As shown in FIG. 4, treated art reproduction 10 is prepared for mounting on stretcher frame 42. Stretcher frame 42 is provided with a side member for each flange of art reproduction 10. Accordingly, as shown in FIG. 4, stretcher frame 42 has side members 44, 46, 48 and 50. Each side member has a top surface 52, which abuts against the underside of image bearing portion 12, and a side surface 54 against which each flange may be folded.

Figure 5:
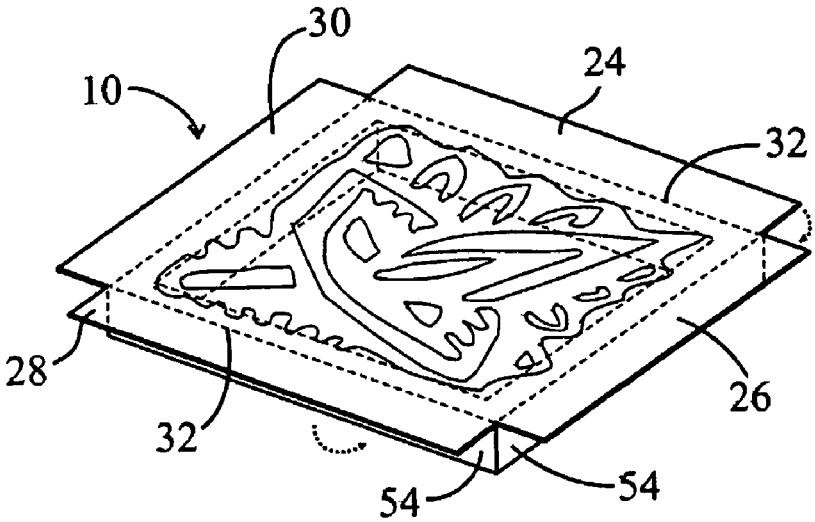
FIG. 5 is a perspective view of the artwork reproduction of FIG. 3 wherein the reproduction has been placed on the stretcher frame and showing two opposed flanges of the substrate being folded downwardly to abut the stretcher frame.
Figure 6:
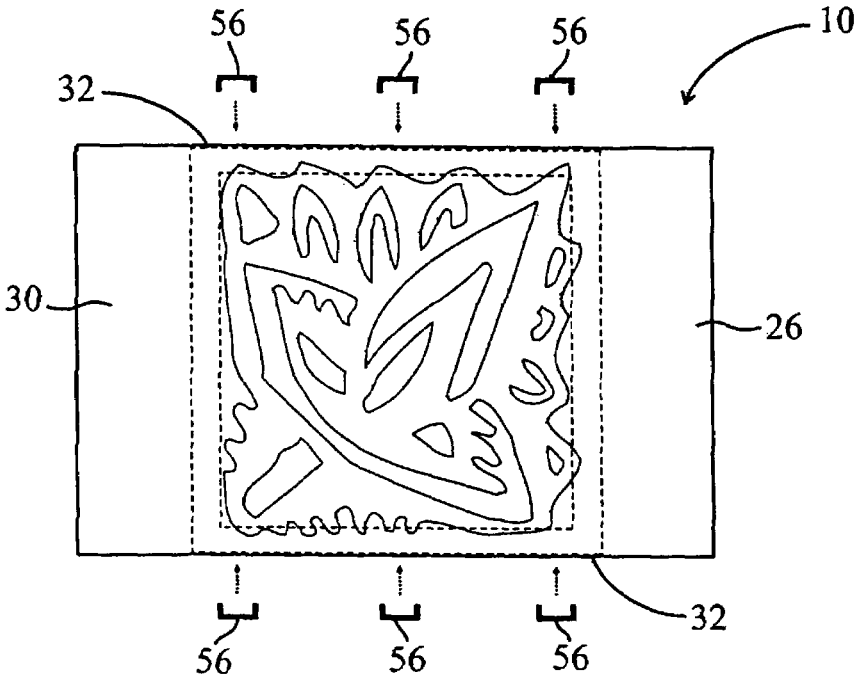
FIG. 6 is a top plan view of FIG. 5 wherein two flanges have been folded down wherein the flanges are in the process of being stapled to the frame.
Figure 7:
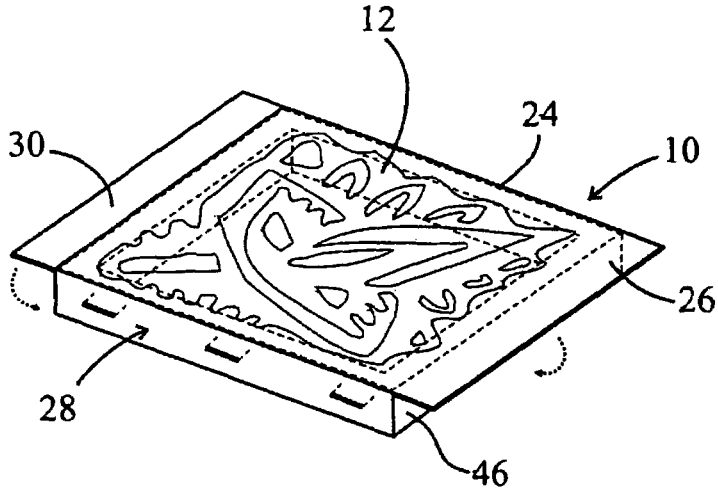
FIG. 7 is a perspective view of the assembly of FIG. 6 wherein the staples have been inserted in opposed sides of the frame.
Figure 8:
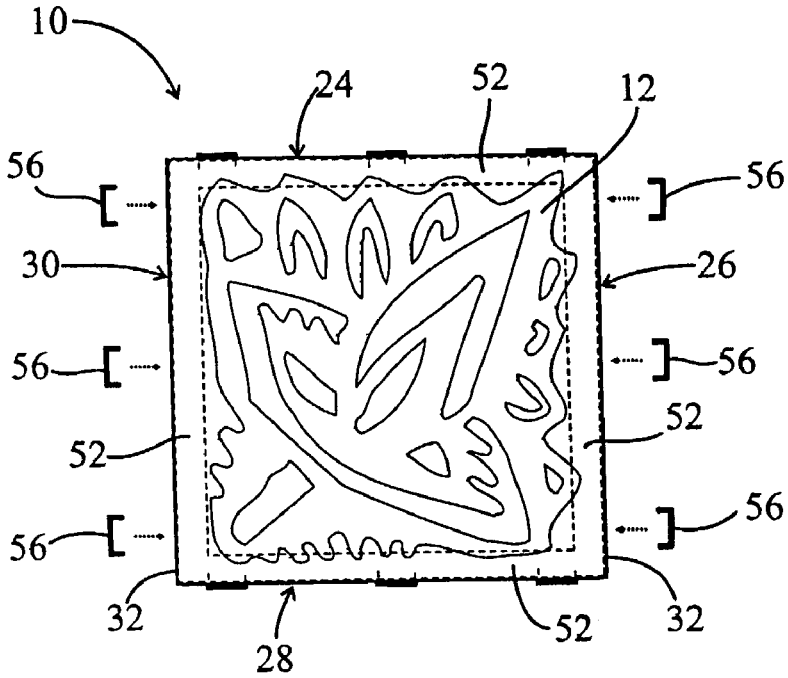
FIG. 8 is a top plan view of the assembly of FIG. 6 wherein the other two opposed flanges of the art work reproduction have been folded down and wherein staples are being inserted into the remaining two sides.

As shown in FIG. 5, image-bearing surface has been placed on top of stretcher frame 42 and flanges 24 and 28 are folded downward to abut against side surfaces 54 thereby being placed in the configuration shown in FIGS. 6 and 7. Flanges 24 and 28 may then be secured to side members 44 and 48 by any means known in the art, such as staples 56 and/or an adhesive. As shown in FIG. 7, the remaining two opposed flanges 26, 30 are folded down against the respective side members 46, 50 to provide the configuration shown in FIG. 8. Accordingly, flanges 26 and 30 are bent along fold lines 30 and then secured to side members 46, 50 by staples 56 and/or an adhesive or any other means known in the framing art.

Figure 9:
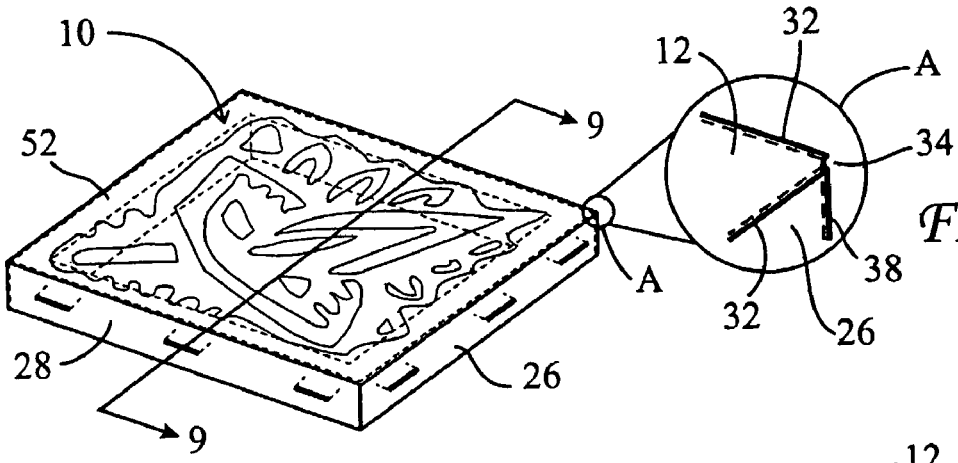
FIG. 9 is a perspective view of the assembly of FIG. 8 wherein all flanges have been folded down and stapled.
Figure 9A:
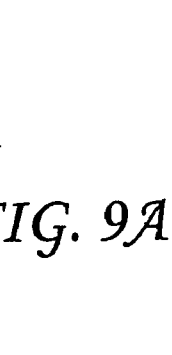
FIG. 9*a* is an enlargement of area A of FIG. 9.
Figure 9B:
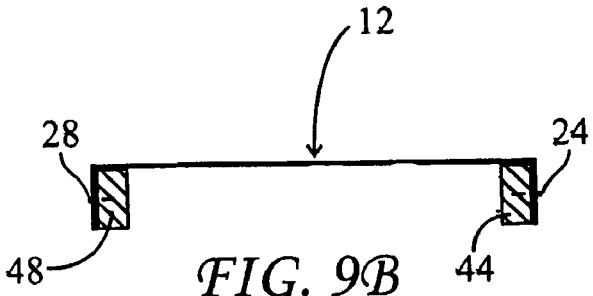
FIG. 9*b* is a cross section along line 9-9 in FIG. 9.
Figure 10:
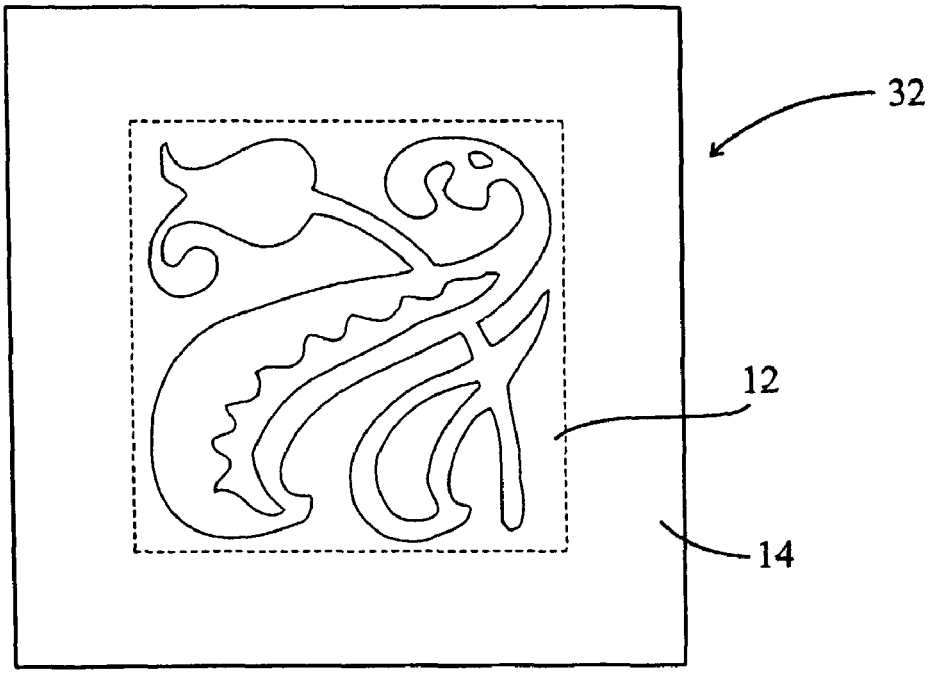
FIGS. 10-19 show a similar series of steps for framing an art reproduction wherein the corners of the flanges of the art reproduction are notched in an alternate manner and are configured according to a second embodiment of one aspect of the instant invention.

In FIG. 9, art reproduction 10 has been secured to the stretcher frame. As shown in FIG. 9*a*, corner notch detail 34 is provided adjacent to corner of the stretcher frame and along fold lines 32. As shown in FIG. 9*b*, image-bearing portion 12 sits over the open area of stretcher frame 42 with flanges 24, 28 secured respectively to side members 44, 48.

FIGS. 10-19 exemplify an alternate framing method according to the same aspect of the invention as exemplified by FIGS. 1-9, but using an alternate production pattern for the corners of an art reproduction. Similar numbers have been used for similar elements.

Figure 11:
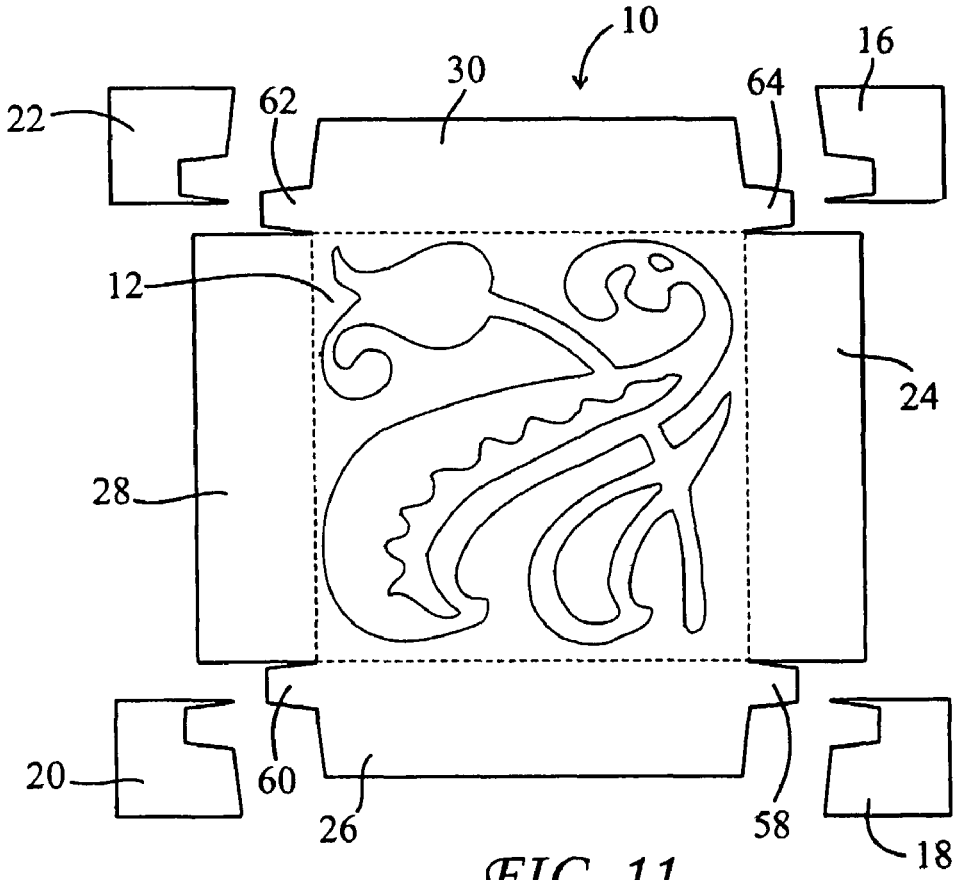
Figure 12:
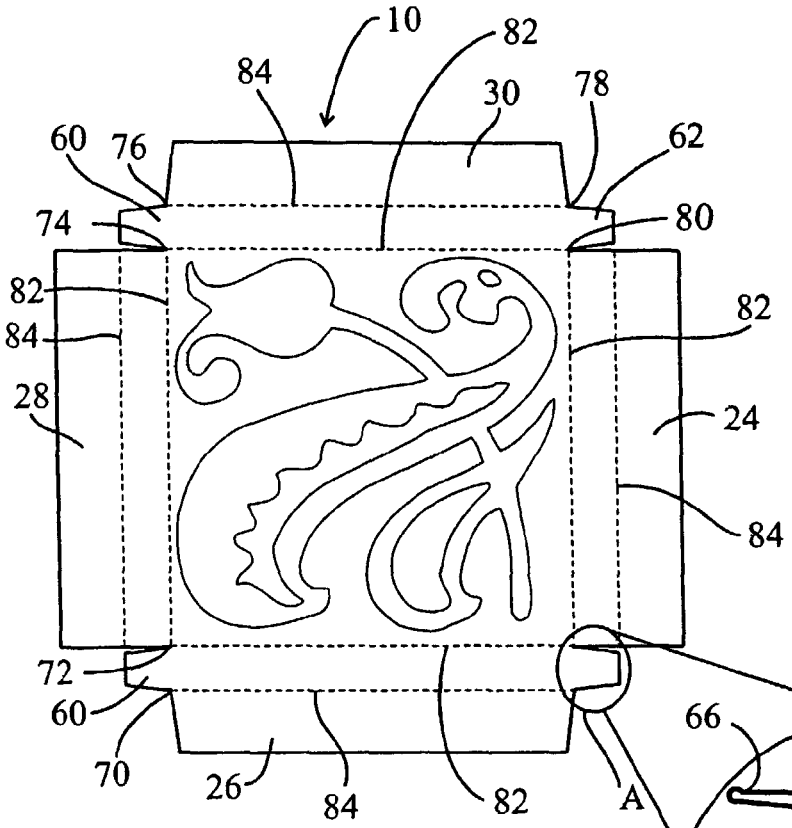
Figure 12A:
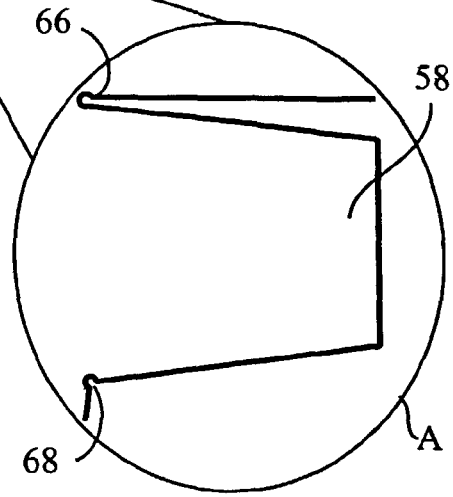
Figure 13:
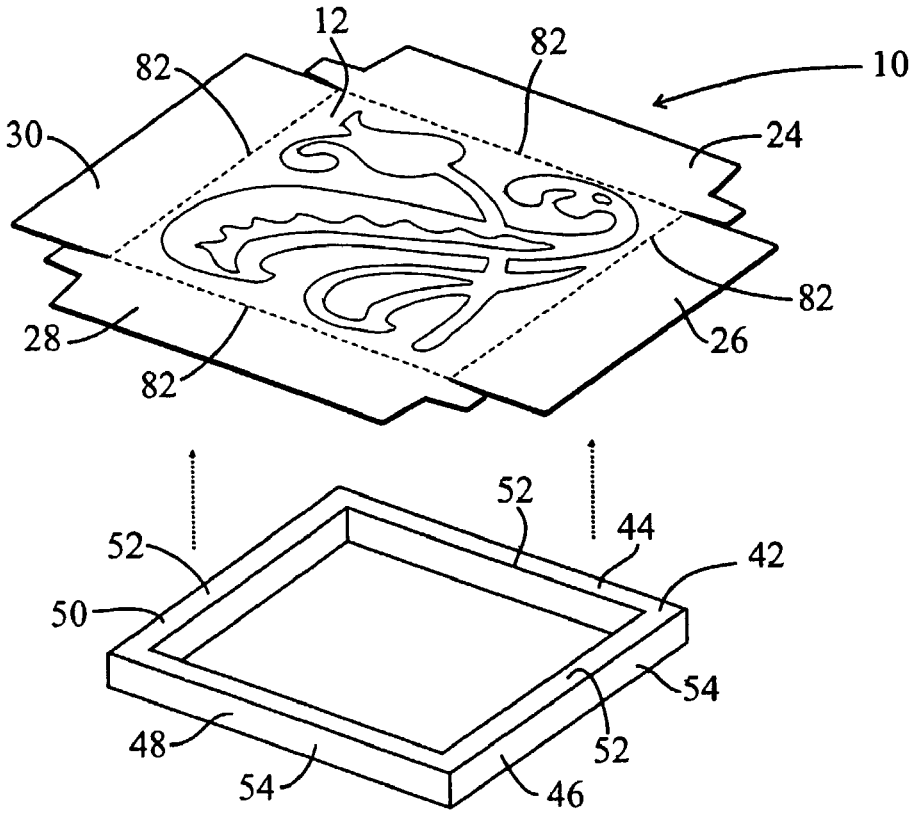
Figure 14:
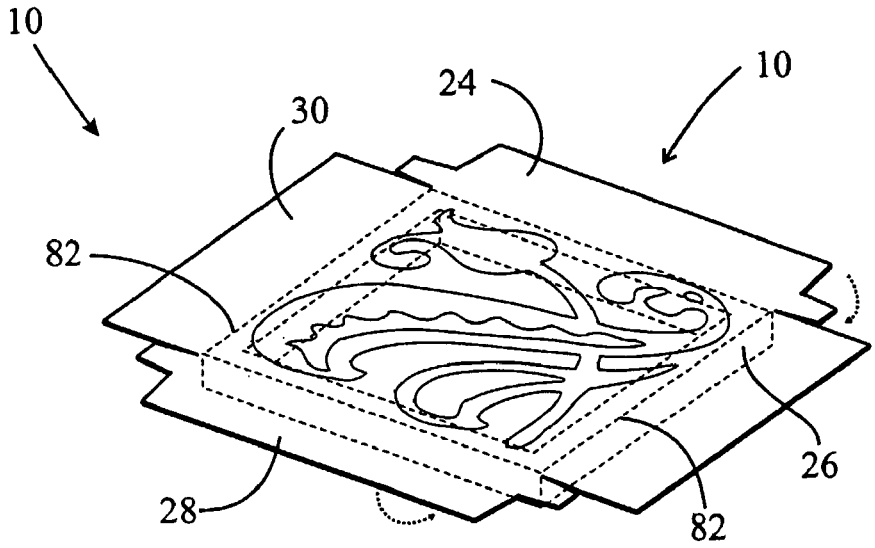
Figure 15:
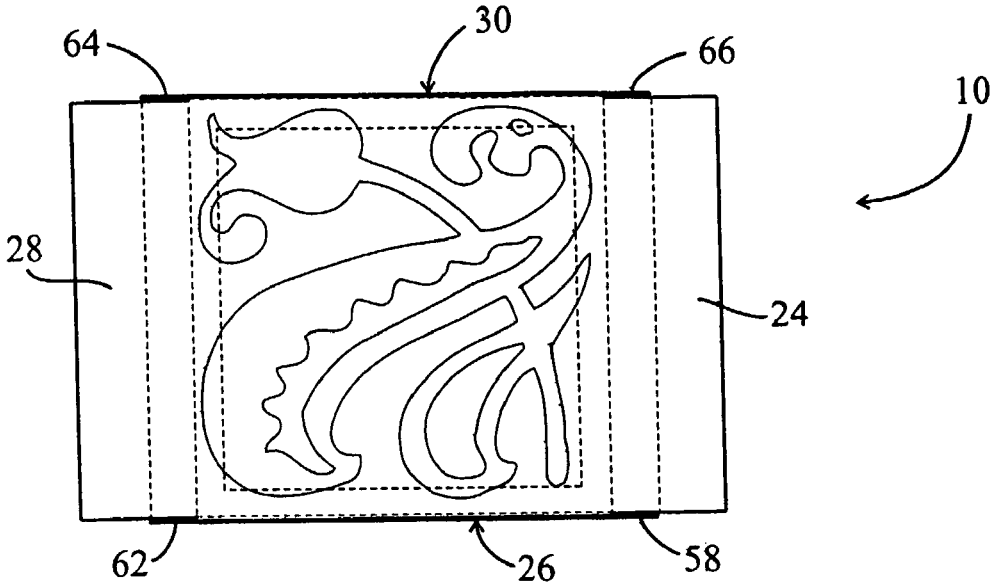
Figure 15A:
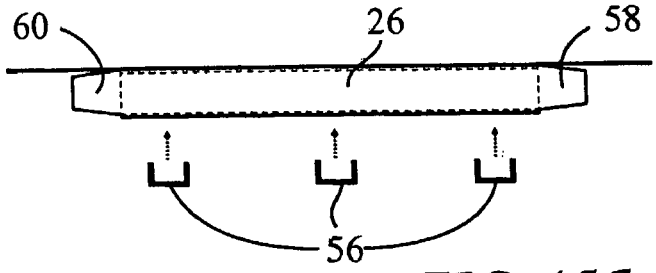

As shown in FIG. 11, the corners of perimeter 14 are notched so as to provide tabs 58, 60, 62 and 64. As shown in more detail on FIGS. 12 and 12*a*, the production of tab 58 results in the production of two points 66, 68 which define corners or sharp intersections of edges of the substrate from which the reproduction is made. Each tab results in the production of two such points. Accordingly, in total, the notching of the substrate as shown in FIG. 12 results in the production of points 66, 68, 70, 72, 74, 76, 78 and 80. In addition, as shown in FIG. 12, inner and outer fold lines 82, 84 are provided in each flange 24, 26, 28 and 30. This permits each flange to be folded adjacent each side surface 54 of stretcher frame 42, as well as the bottom surface of each side member of the stretcher frame (see for example FIGS. 15, 17 and 19*b*). Accordingly, in accordance with this embodiment, the substrate is secured to both the side surfaces and bottom surfaces of the side members of the stretcher frame. In accordance with the instant invention, at least one and preferably all of the points 66, 72, 74, 80 along the inner fold line and, preferably, all of the points along the inner and outer fold lines 82, 84, and points 66, 68, 70, 72, 74, 76, 78 and 80 are radiused or provided with round or oval stress relief cuts to prevent or reduce the tearing or fracturing of the substrate.

Figure 16:
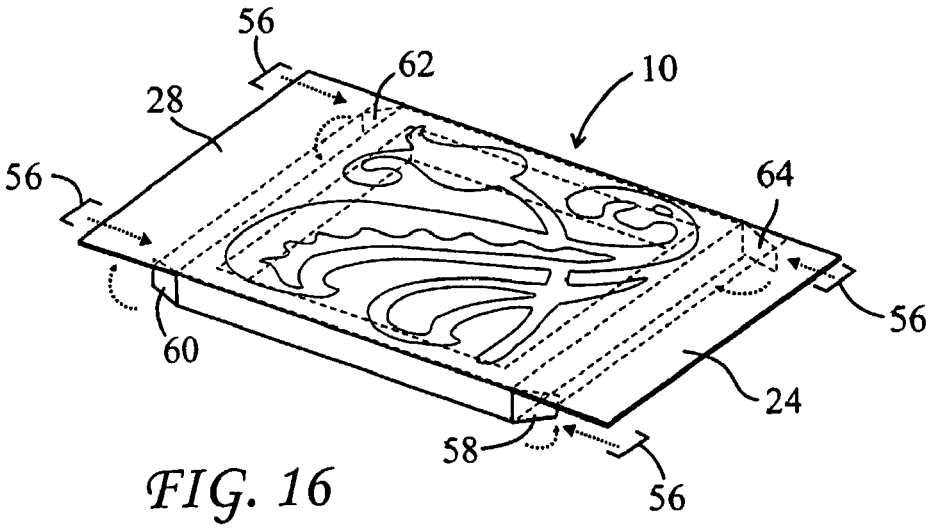
Figure 17:
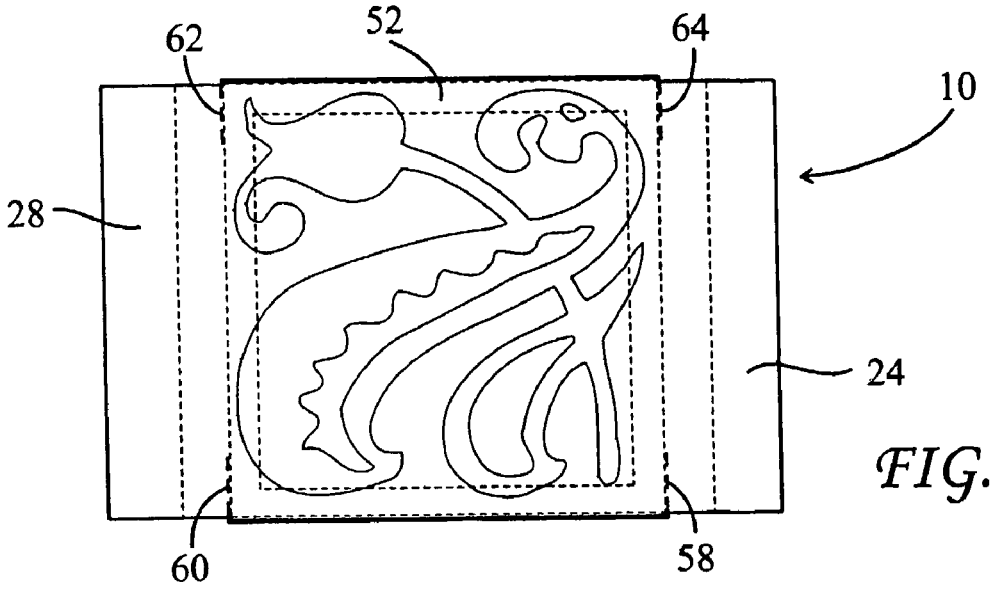
Figure 17A:
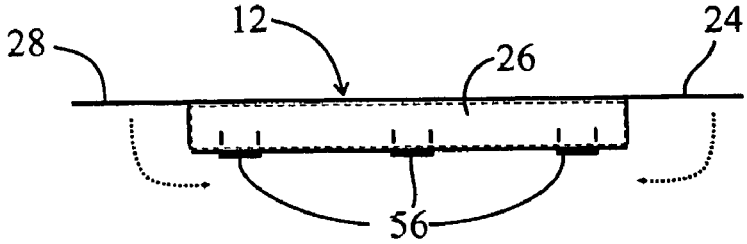
Figure 18:
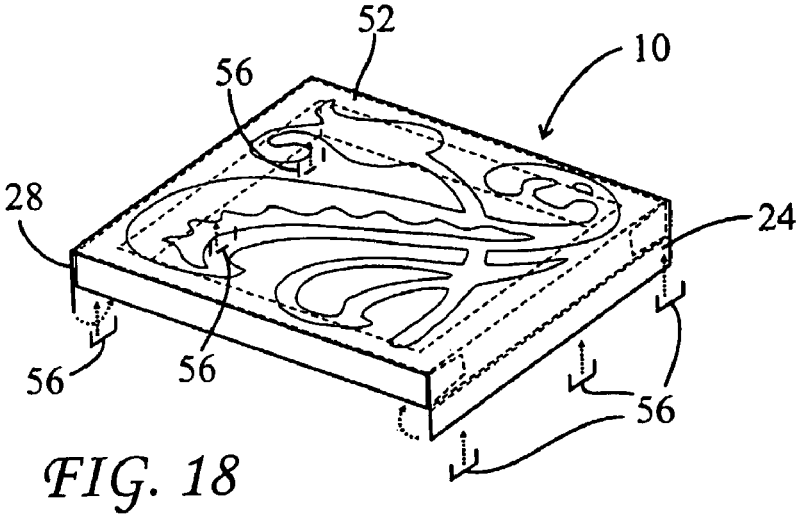

Once the substrate has been placed on stretcher frame 42 (see FIGS. 13 and 14), opposed edges 26, 30 may be folder along inner fold line 82 such that flanges 26, 30 lay adjacent the respective side members. Subsequently, flanges 26, 30 may be folded along outer fold lines 84 such that the flanges abut against the rear surface of back face of stretcher frame 42. The flanges may be then secured to the rear surface of the side members by staples 56 and/or by an adhesive or by any other method known in the framing art. Subsequently, as shown in FIG. 16, tabs 58, 60, 62, and 64 may be folded inwardly to the position shown in FIG. 17 at which time flanges 24, 28 may be folded downwardly, as shown in FIG. 17*a* and then inwardly, as shown in FIG. 18 such that side flanges 24, 28 abut against the rear surface of their respective side members of stretcher frame 42. These flanges may then be secured to the lower surface of stretcher frame 42 by staples and/or an adhesive or other means as known in the art.

Figures 19, 19A, 19B:
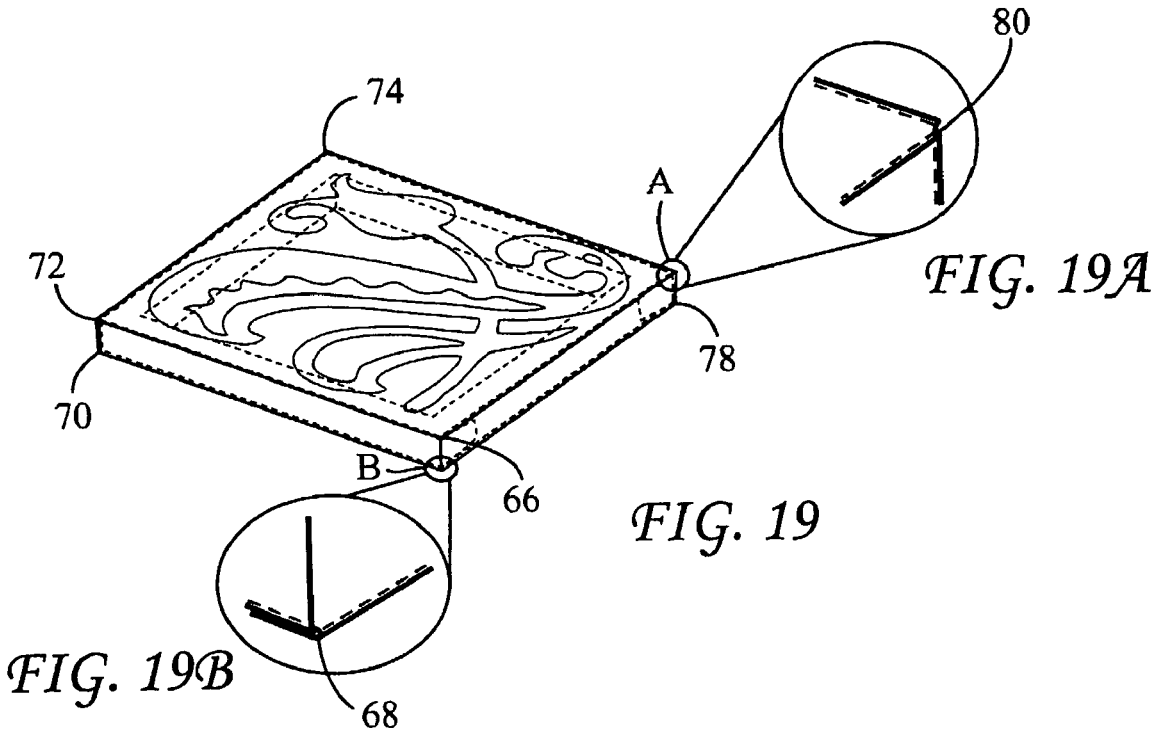
Figure 20:
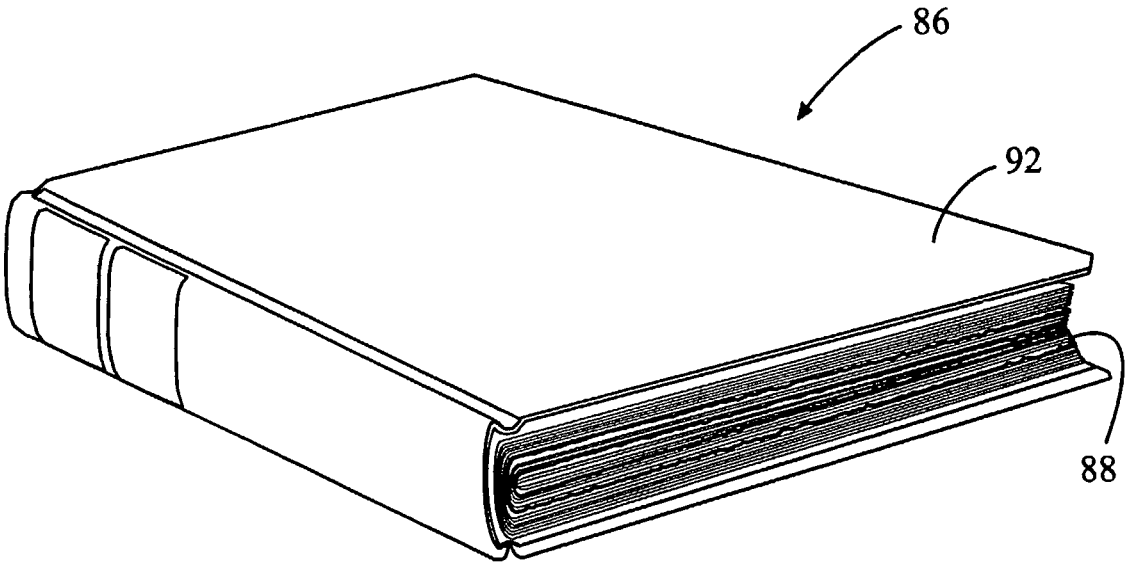
FIG. 20 is a perspective view of a publication in accordance with another aspect of this invention wherein the publication has four pages composed of a printed substrate.
Figure 21:
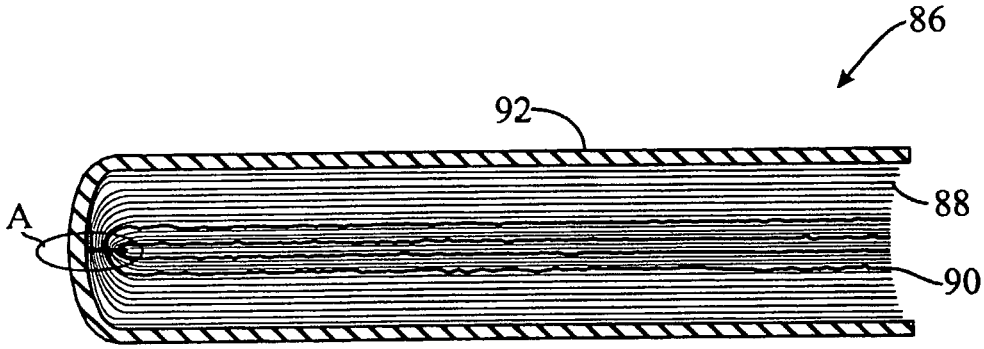
FIG. 21 is an end view of the publication of FIG. 20.
Figure 22:
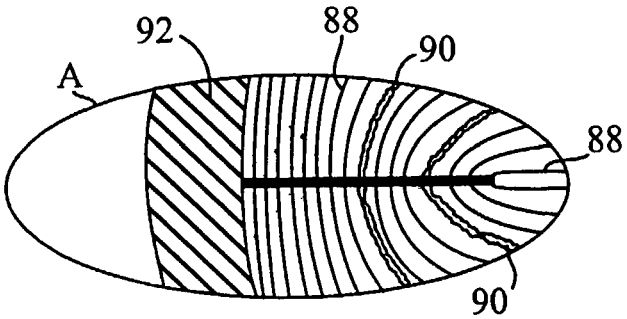
FIG. 22 is an enlargement of area A shown in FIG. 21.

FIGS. 19, 19*a* and 19*b* show an art reproduction in accordance with one embodiment of the instant invention wherein all edges have been folded down and around to the rear or bottom face of stretcher frame 50, as shown in dashed outline, wherein the tabs have been folded under and stapled and round or oval transitions have been provided at the intersection of the cut lines to prevent or reduce tearing or fracturing.

The substrate is preferably a plastic or metal and, more preferably, a thermoformable plastic. The thermoformable plastic is preferably poly vinyl chloride, polystyrene, neoprene, polyethylene, ABS, PET, and, preferably, is EVA, PVC or polystyrene and, most preferably, is polystyrene. The metal is preferably aluminium or brass. One advantage of the use of neoprene is that neoprene may be reversibly deformable and, accordingly, can be reused in the process. If the substrate is an irreversibly deformable thermoplastic such as polystyrene, then the thermoformable plastic may be recycled by grinding the used substrate as is known in the art.

The plastic substrate may have a thickness from 0.002-0.100 inches, preferably from 0.003-0.025 inches, more preferably from 0.006-0.012 inches. The metal substrate may have a thickness from 0.002 to 0.060 inches, preferably 0.003 to 0.020 inches and most preferably 0.005 to 0.012 inches.

The image provided on image bearing portion 12 may be a two-dimensional printed image (i.e. it may be an image which is printed by lithography or any other printing means known in the art). Alternately, the image may be treated to have a three-dimensional image, such as a picture, provided therein. The substrate may be prepared by pressure forming, vacuum forming, pressure and vacuum forming, embossing, applying a variable mechanical force to the substrate so as to produce a plurality of depths in the Z dimension. The variable mechanical force may be produced by a printing head, such as a dot matrix printing head, a daisy wheel printing head, by a plurality of pins or an eclectic deformable LCD whereby a computer signal will result in a physically member contacting and depressing the substrate at different locations. Preferably, the substrate is prepared by pressure and/or vacuum forming. Most preferably, image bearing portion 12 comprises a two-dimensional image provided on the substrate and a relief pattern or topography corresponding to the image is formed there, e.g., a printed three-dimensional image. It would be appreciated that the actual method by which the image and/or the topography are formed in the substrate does not comprise part of this invention and any such method known in the art may be utilized.

Prior to the substrate being subjected to any of the forgoing processes, the rigidity of the substrate may be temporarily reduced such as by increasing the temperature of the substrate or the addition of a chemical additive whose effect or presence is transient. For example, polystyrene, poly vinyl chloride or ABS may be exposed to methyl ethyl ketone (MEK). The MEK results in the thermo-formable plastic temporarily softening thereby enhancing the molding operation.

Such processes and substrates are described in co-pending U.S. patent application Ser. No. 11/571,323 entitled Method For The Automated Production Of Three-Dimensional Objects And Textured Substrates From Two-Dimensional Or Three-Dimensional Objects, the disclosure of which is incorporated herein by reference.

It would also be appreciated that the image need not be an artwork but may be of any design. For example, the image may be an advertisement, movie poster, machine produced art or reproduction, a photographic likeness with three dimensional relief to more closely simulate real life, or point of sale fixtures or portions thereof.

In accordance with another embodiment with the instant invention, in addition to the opposed ends or sides 36, 38 being radiused where they meet, the thickness of the substrate adjacent the intersection of opposed ends 36, 38, namely point 40, may also be thickened thereby reducing the tendency for the substrate to crack or fracture when the point or corner 40 is radiused or otherwise configured in accordance with the instant invention. As such, the upper and/or lower surfaces 37, 39 of the substrate may extend out of the plain of the substrate adjacent the point. Preferably, the substrate is gradually thickened so that the substrate adjacent point 40 curves out of the plain defined by the substrate.

In accordance with an alternate embodiment of the instant invention, a plastic substrate which has a two-dimensional image printed thereon and/or has a three dimensional image or topography formed therein, may be incorporated with publication 86. Publication 86 has a plurality of pages 88 including at least one and preferably a plurality of pages 88 which are made from a plastic substrate.

Figure 23:
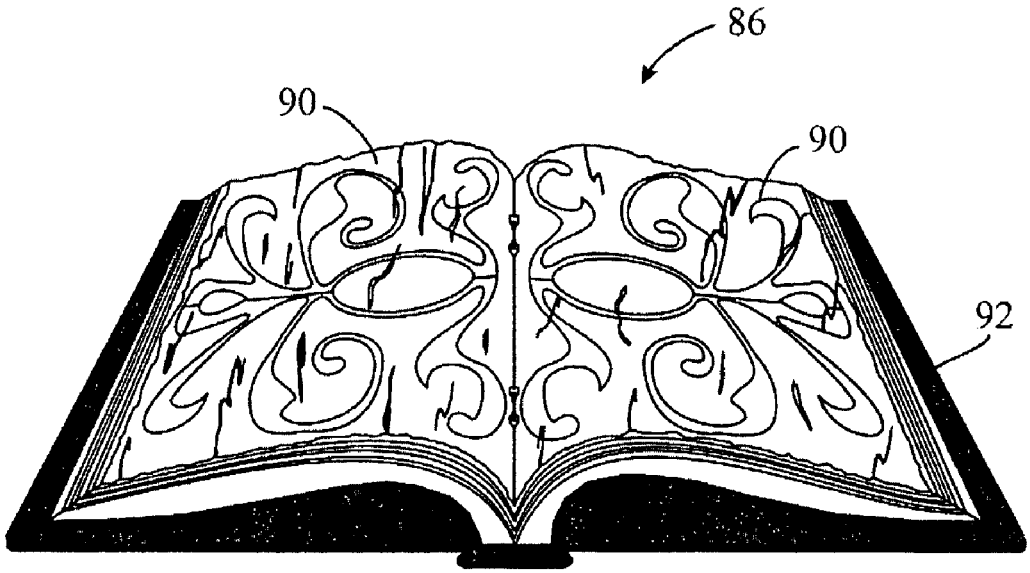
FIG. 23 is a perspective view of the publication of FIG. 20 opened to one of the pages having the printed substrate.
Figure 24:
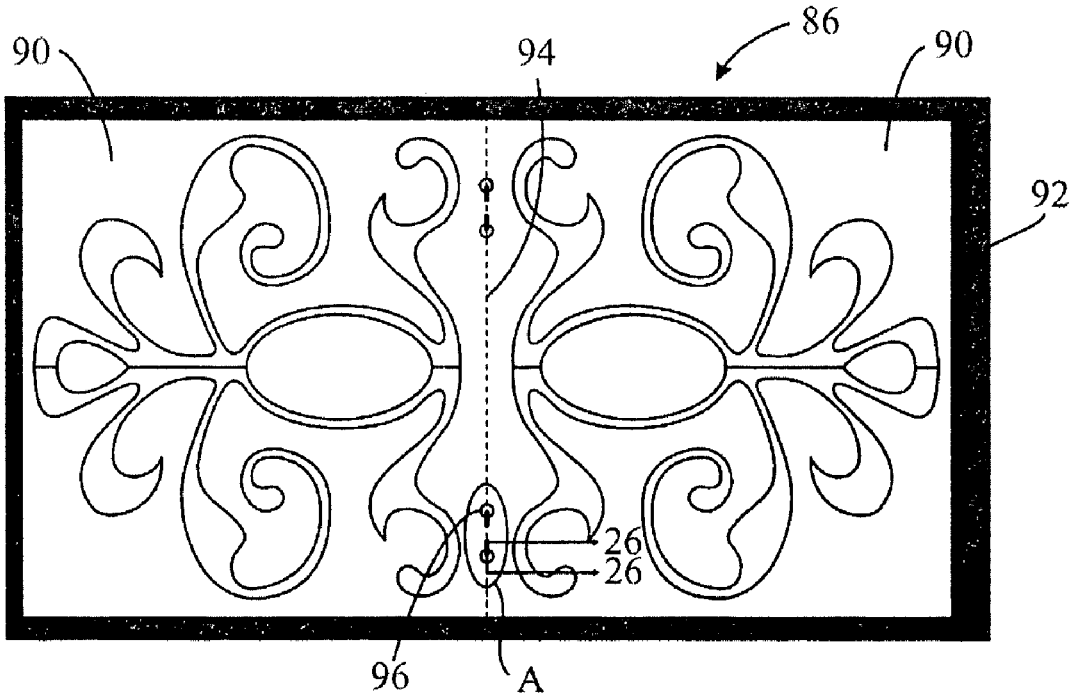
FIG. 24 is a top plan view of FIG. 23.

In this embodiment, substrate 90 may be made by any method disclosed herein and may have any image, text, design and/or other material typically included in a publication provided thereon. Preferably, as shown in FIGS. 23 and 24, substrate 90 may be provided at the centre of the publication so as to form a two-page layout. As shown therein, the substrate may comprise an elongated sheet that is sized to occupy two pages. The substrate has a centre line 94 which may be scored or treated to assist substrate 90 being folded in half when the publication is closed. Alternately, the substrate may be thinner along the centre line 94. Alternately, the substrate may be sized to comprise a single page. In accordance with this alternate embodiment, the substrate need not be folded in half when the publication is closed.

Publication 10 may be any publication that contains a plurality of pages. For example, publication 10 may be a book (which may be a hard cover or a soft cover book). In addition, publication 10 could be a magazine, journal, an art book, a calendar, a brochure, an advertising flyer or insert to a magazine or other publication, an instruction manual, a scroll, a selected portion of a book such as a cover or an interior cover, or the packaging used to transport or distribute other products or the like. Examples of such publications include business journals, medical journals, annual company reports, works of fiction and non-fiction, art books, instruction manuals, calendars, and the packaging used to transport or distribute other products. Publication 10 may have one or more pages made from a non-cellulose based substrate and may have a plurality of pages that are plastic.

It will be appreciated that the type of binding that is utilized may vary depending upon the type of publication. For example, in the case of a magazine, the publication may be secured by staples. Alternately, in the case of a book, the pages may be secured together by stitching or stitching and an adhesive. In a preferred embodiment, the binding includes an elongate member, such as staples or stitching, which passes through the composite work 14.

Binding that uses staples or stitching use an elongate member that extends through a plurality of pages. Accordingly, in the case of a magazine, the elongate member may be a staple that extends through all of the pages so as to secure the pages together. Typically, two such staples are provided at spaced apart locations along the spine of a magazine. In the case of a book, a plurality of pages may be secured together by passing thread through the pages by a needle or other penetrating member as known in the art.

Figure 25:
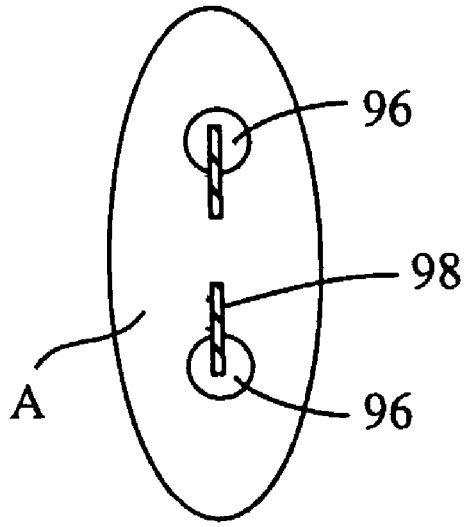
FIG. 25 is an enlarged view of area A of FIG. 24.

If the substrate 90 is included in such a publication, then the staple or thread will pass through the substrate. In accordance with this aspect in the instant invention, the substrate is configured so as to enable the elongate member to pass therethrough thereby reducing the likelihood of the substrate tearing or fracturing. Accordingly, the substrate may be provided with holes or openings 96 through which an elongate member, such as staple 98, may extend (see FIGS. 24-26). Such openings are configured so that there is not an angle over 5°. It would be appreciated that holes 96 need not be circular. Accordingly, while holes 96 may be circular or oval, then may merely be radiused so as to have a continuous perimeter.

By providing holes that are preformed in the substrate, the substrate need not be pierced during the binding operation. Instead, during the binding operation, substrate 90 may merely be positioned so that holes 96 are aligned with the staple or elongate member that is to extend therethrough. It would be appreciate that holes 96 may be provided in substrate 90 when the rigidity of substrate 90 has been temporarily reduced, such as by heating or chemical treatment with, e.g. methyl ethyl ketone. It will also be appreciated that holes 96 may be formed during the binding process.

Figure 26:
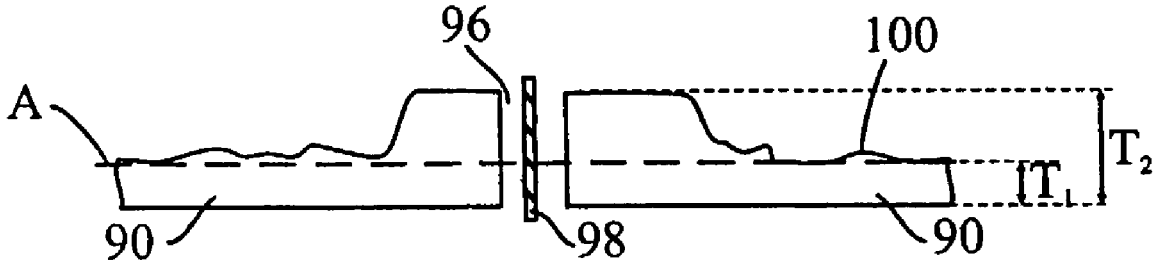
FIG. 26 is a cross section along the line 26-26 shown in FIG. 24.

In accordance with an alternate embodiment of the instant invention, substrate 90 may have an increased thickness in the vicinity of hole 96. For example, as shown in FIG. 26, substrate 90 generally extends along plane A. It will be appreciated that the actual thickness may vary if substrate 90 is provided with a three-dimensional image or topography 100 formed therein. Distal to hole 96, substrate 90 has a thickness of about T1. However, adjacent hole 96, the thickness of substrate 90 has been increased to T2. Accordingly, the image-bearing surface of substrate 90 extends out of plane A adjacent the perimeter of opening or hole 96. It would be appreciated that only one, or each, opposed surface of substrate 90 may be configured to extend out of plane A.

In accordance with another aspect of the instant invention, a frame or mount for a poster, art work, an advertisement or the like may be configured to interchangeably receive at least one light emitting member and optionally, to interchangeably receive a plurality of light emitting members. The light emitting may be a light bulb, LED or the like. A plurality of light emitting members having different lighting properties (such as colour, intensity of light, etc and, preferably creating an overall light colour which is pleasing to the viewer based upon the ambient lighting, size, and content including dominant colours of the image versus its surroundings) may be provided as part of a kit or may be obtained separately. Accordingly, the light-emitting member may be selectively changed thereby permitting different lighting effects to be provided. For example, the light that is used may be selected to provide a warmer or cooler light, to have a broader angle of dispersion, or to differentially illuminate portions of the artwork or image so as to accent or highlight key features.

Alternately, or in addition, the mount for receiving the light emitting member is moveably mounted to the frame so that the mount may be moved between an in use position, in which the light emitting member is spaced from the art reproduction in the frame so as to be able to provide lighting directed at the art reproduction, and a shipping position wherein the mount is positioned adjacent the frame and/or the art reproduction thereby reducing the dimension of the packaging of the art reproduction.

In accordance with a further alternate embodiment of the instant invention, and art reproduction is provided with at least one light emitting member, a member to monitor the time of day and a controller to adjust the intensity of the light emitted by the light emitting member, the colour of the light emitted by the light emitting member and/or two actuate the light emitting member based upon the time of day. Accordingly, a user may program the controller to preprogram one or more portions of the day when the light-emitting member is actuated and/or the colour and/or intensity of light which is emitted by the light-emitting member during a day or portion of a day.

In accordance with a further alternate embodiment of the instant invention, an art reproduction is provided with at least one light emitting, a member to monitor the light in a room where the art reproduction is positioned and a controller to adjust the intensity and/or colour of the light emitted by the light emitting member, including turning on the light emitting member based upon the intensity of the light in a room. Accordingly, when an art reproduction is mounted in a room, the light emitting member may only be automatically actuated at night or at dusk, or alternately, the intensity and/or colour of light emitted by the light emitting member may be automatically increased or changed as a room darkens (i.e. as day passes towards dusk), and, similarly, the intensity of a light emitting member may be reduced or changed as dawn approaches.

It would be appreciated that each of these alternate lighting assemblies may be provided as part of the frame or mount for an art work that may be used in association with an art reproduction as disclosed herein or, alternately, with any art work or other element which is framed for hanging on a wall, ceiling or the like.

In accordance with a particularly preferred aspect of the instant invention, the image on the art reproduction may be a family portrait or a picture of one or more individuals.

It would be appreciated that various modifications and additions may be made to the embodiments disclosed herein and each are in the scope of the following claims.

The invention claimed is:

1. A member comprising:

(a) a deformable self supporting substrate having an image reproduced on a face thereof, (b) the substrate having first and second portions, the two portions meeting at a first fold line, the first fold line having first and second opposed ends; and, (c) at least one of the ends is configured to reduce propagation of stress along the first fold line wherein the first portion of the substrate has an image provided thereon and the second portion of the substrate defines a first flange and the flange is secured to a frame.

2. The member of claim 1 wherein each of the portions has an edge, the edges meet at one of the opposed ends, when the portions are folded along the first fold line a section of each edge adjacent the first fold line defines a point and the sections of each edge adjacent the first fold line are rounded in planes defined by the portions of the substrate.

3. The member of claim 2 wherein the sections are radiused in the planes defined by the portions of the substrate.

4. The member of claim 2 wherein the sections create a generally concave indent when viewed from the edges.

5. The member of claim 1 wherein when the portions are folded along the first fold line a section of each edge adjacent the first fold line defines a point, the substrate has a thickness, and the thickness is increased adjacent the point.

6. The member of claim 1 wherein each of the portions has an edge and generally extends in a plane, the edges meet at a point at one of the opposed ends, and the substrate is configured to extend out of the planes adjacent the point.

7. The member of claim 6 wherein a section of the substrate adjacent the point is curved out of the planes.

8. The member of claim 1 wherein the first portion has an image provided thereon and the member is incorporated into a bound publication.

9. The member of claim 8 wherein the image comprises an advertisement.

10. The member of claim 8 wherein the bound publication has a plurality of pages and a spine, and the first fold line is positioned adjacent the spine.

11. The member of claim 10 wherein at least some of the pages are secured together by an elongate member.

12. The member of claim 11 wherein the elongate member passes through the substrate adjacent the first fold line.

13. The member of claim 12 wherein the substrate is provided with an opening that the elongate member passes through.

14. The member of claim 13 wherein the opening has a round perimeter.

15. The member of claim 13 wherein the opening has a perimeter, the substrate has a thickness and the thickness of the substrate is increased adjacent the perimeter of the opening.

16. The member of claim 13 wherein the opening has a perimeter, each of the portions generally extends in a plane, and the substrate is configured to extend out of the planes adjacent the perimeter of the opening.

17. The member of claim 16 wherein a section of the substrate adjacent the perimeter of the opening is curved out of the planes.

18. The member of claim 1 wherein the substrate is deformed by heat and/or pressure.

19. The member of claim 18 wherein the substrate is a thermoformable plastic.

20. The member of claim 18 wherein the substrate is plastic or metal.

21. The member of claim 1 wherein the plastic is polystyrene.

22. The member of claim 1 wherein the member comprises artwork.

23. The member of claim 1 wherein the substrate further comprises a third portion, the first and third portions meeting at a second fold line, the second fold line having first and second opposed ends, the one of the ends of the first fold line is positioned adjacent one of the ends of the second fold line to define a corner and the corner is configured to reduce propagation of stress along the fold line.

24. The member of claim 22 wherein the substrate has a plurality of flanges for mounting the substrate to the frame and corners positioned between the flanges and at least some of the corners having a portion that is rounded.

25. The member if claim 24 wherein all of the corners are rounded.

* * * * *